US006418159B1

(12) United States Patent
Umemoto

(10) Patent No.: US 6,418,159 B1
(45) Date of Patent: Jul. 9, 2002

(54) PORTABLE RADIO TELEPHONE EQUIPMENT AND CONTROL THEREOF

(75) Inventor: Yuji Umemoto, Hino (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/117,842

(22) PCT Filed: Dec. 9, 1997

(86) PCT No.: PCT/JP97/04512

§ 371 (c)(1),
(2), (4) Date: Aug. 6, 1998

(87) PCT Pub. No.: WO98/26525

PCT Pub. Date: Jun. 18, 1998

(30) Foreign Application Priority Data

Dec. 9, 1996 (JP) ..... 8-328770

(51) Int. Cl.[7] ..... H04B 1/38

(52) U.S. Cl. ..... 375/219; 375/222; 375/232; 375/285; 375/296; 455/570

(58) Field of Search ..... 375/222, 219, 375/232, 350, 285, 259, 295, 296; 704/233, 221, 226; 379/410; 455/558, 570

(56) References Cited

U.S. PATENT DOCUMENTS

| | | | | | |
|---|---|---|---|---|---|
| 5,559,881 | A | * | 9/1996 | Sih | 379/410 |
| 5,920,834 | A | * | 7/1999 | Sih et al. | 704/233 |
| 6,081,732 | A | * | 6/2000 | Suvanen et al. | 455/570 |
| 6,192,255 | B1 | * | 2/2001 | Lewis et al. | 455/558 |

FOREIGN PATENT DOCUMENTS

| | | |
|---|---|---|
| JP | 8-265208 | 10/1996 |
| JP | 9-148963 | 6/1997 |
| JP | 9-326844 | 12/1997 |

* cited by examiner

*Primary Examiner*—Don N. Vo
(74) *Attorney, Agent, or Firm*—Finnegan, Henderson, Farabow, Garrett & Dunner, L.L.P.

(57) ABSTRACT

A portable radio telephone device and control method for same aimed at improving call quality by eliminating unstable operation of the noise canceller at the start of a call due to call origination or call reception, or when in-call muting is cancelled, or when hand-over or resynchronization processing is completed. When the speech codec (11) is set to a normal operational state, the noise canceller (12) is activated before the start of operation of the voice encoding/decoding means by at least the time period required for the learning process, such that when the speech codec (11) is in normal operation, the learning operation of the noise canceller (12) is in a converged state.

18 Claims, 6 Drawing Sheets

PORTABLE RADIO TELEPHONE EQUIPMENT AND CONTROL THEREOF

TECHNICAL FIELD

This invention relates to a portable radio telephone device used as a mobile station, such as a cellular system, PHS (personal handy phone system), or the like, and a control method for same, and in particular, it relates to a radio telephone device and control method for same, which is improved such that deterioration of call quality due to unstable operation of the noise canceller, which removes ambient noise, is prevented.

BACKGROUND ART

TDMA (Time Division Multiple Access) is known as one communications method used in recent digital portable telephone system. This method is extremely valuable in increasing channel capacity by enabling a plurality of channels to be transmitted on the same radio channel by compressing voice signals by means of digital signal processing.

Furthermore, VSELP (Vector Sum Excited Linear Prediction) is commonly used as a digital voice processing method in a full-rate codec.

Since a voice processing system of this kind involves only having a code book for voice signals, an unnatural transmission signal is produced when sound other than a voice, such as noise, for example, is transmitted, and in circumstances where there is a high level of ambient noise, or. the like, this has a significant effect on the quality of the communicated voice signal.

As a countermeasure against this, generally, a method whereby the ambient noise is reduced by providing a noise canceller function is employed. In particular, in PSI-CELP (Pitch Synchronous Innovation CELP) systems which have a high compression rate and are used in a half-rate codec, voice pitch information is used in the encoding process, and therefore sound distortion due to noise occurs readily, so a noise canceller is indispensable for maintaining call quality.

Incidentally, a noise canceller cancels noise by extracting noise components from an input sound signal containing ambient noise by means of an adaptive filter, and mixing components of opposite phase into the aforementioned input sound signal, and generally, a Carman filter is used as the adaptive filter and a structure is adopted whereby a learning operation is carried out according to the ambient noise component, such that the filter tap coefficient is an optimum value.

Therefore, if there is not sufficient learning time, for example, the amount of noise cancellation will decline and it will not be possible to implement an effective noise cancelling operation.

For example, immediately after the start of a call, the noise canceller has only just started to operate and the tap coefficient of the adaptive filter is in an unspecified (not yet converged) state, meaning that there is inadequate noise cancellation and therefore unwanted noise is audible to the other party, which obstructs the call.

Usually, a time period of approximately four seconds is required for complete convergence, but it is known that after approximately two seconds, at least, it is possible to cancel the noise component to a certain level.

However, with regard to call quality, the fact that a noise component is present in the call signal for two seconds even represents a very significant demerit.

Furthermore, since the convergence of the noise canceller produces an effect whereby, in the next step, the noise component suddenly reduces, the call sounds very unnatural to the other party.

Moreover, whilst it is common for portable radio telephones used in this type of system to incorporate a function whereby the user can mute the transmitted sound consciously by his/her own operation, since the input of ambient noise to the noise canceller is temporarily prohibited when this mute function is operated, the learning operation of the noise canceller is interrupted temporarily and the learning operation must start again after the mute function has been cancelled, thereby causing unavoidable deterioration of call quality due to insufficient convergence of the noise canceller, similarly to the start of a call.

Furthermore, if the portable radio telephone moves during a call, or the radio state deteriorates, a so-called hand-over operation for changing the base station, or resynchronization processing for resynchronizing with the base station, is implemented, but since the input of ambient noise to the noise canceller is temporarily prohibited in this case also, the learning operation of the noise canceller is interrupted temporarily and the learning operation must start again after the mute function has been cancelled, thereby causing unavoidable deterioration of call quality due to insufficient convergence of the noise canceller, similarly to the start of a call.

In this way, in the conventional device described above, the noise canceller does not converge and the amount of reduction of the noise component is insufficient immediately after the start of communications, when a call is made or received, thereby causing unnatural noise to be audible to the other party.

Moreover, when a mute function is engaged by the user, or when hand-over or resynchronization processing is implemented, the call quality is impaired dramatically by generation of unnatural noise when the mute function is cancelled, or when the hand-over or resynchronization processing is completed.

DISCLOSURE OF THE INVENTION

Therefore, it is an object of the present invention to provide a portable radio telephone and a control method for same, whereby call quality can be improved by eliminating unstable operation of the noise canceller at the start of communications, when a call is made or received, when the mute function is cancelled during communications, or when a hand-over or resynchronization operation is completed.

In order to achieve the aforementioned objects, this invention comprises: a noise canceller for removing noise components by extracting the noise components from a transmission voice signal and mixing components of opposite phase to the extracted noise components into the transmission voice signal; voice encoding means for encoding the transmission voice signal from which the noise components have been removed by the noise canceller; and control means for activating the noise canceller before the start of operation of the voice encoding means.

Here, a composition may be adopted, wherein the noise canceller extracts the noise components by a learning process, and the control means starts the learning extraction operation of the noise components by the noise canceller before the start of operation of the encoding means by at least a time period required for extraction of the noise components.

Here, a composition may be adopted, wherein the noise canceller comprises an adaptive filter for extracting noise components from a digital transmission voice signal, and the adaptive filter determines a filter tap coefficient by means of a learning operation such that it is optimal with respect to the noise components contained in the digital transmission voice signal.

Furthermore, a composition may also be adopted, wherein, during start-up of a communications channel relating to call origination or call reception, the control means sets the noise canceller to an operational state before the start of operation of the voice encoding means, and sets the voice encoding means to an operational state after a response by a user on the communications channel.

Moreover, a composition may be adopted, wherein the control means sets the voice encoding means to an idle state and the noise canceller to an operational state in response to a muting operation during a call, and sets the voice encoding means to an operational state in response to cancellation of the muting operation.

Furthermore, a composition may be adopted, wherein the control means sets the voice encoding means to an idle state and the noise canceller to an operational state in the event of hand-over or resynchronization processing during a call, and sets the voice encoding means to an operational state in response to completion of the hand-over or resynchronization processing.

Moreover, this invention comprises: a noise canceller for removing noise components by extracting the noise components from a transmission voice signal and mixing components of opposite phase to the extracted noise components into the transmission voice signal; voice encoding means for encoding the transmission voice signal from which the noise components have been removed by the noise canceller; and control means for activating the noise canceller before the start of normal operation of the voice encoding means, and setting the voice encoding means to a silent signal generating state for generating a silent signal until normal operation of the voice encoding means starts.

Here, a composition may be adopted, wherein during start-up of a communications channel relating to call origination or call reception, the control means sets the voice encoding means to generation of a silent signal and the noise canceller to an operational state, and returns the voice encoding means to a normal operational state after a response by a user on the communications channel.

Furthermore, a composition may be adopted, wherein the control means sets the voice encoding means to generation of a silent signal and the noise canceller to an operational state in response to a muting operation during a call, and returns the voice encoding means to a normal operational state in response to cancellation of the muting operation.

Moreover, a composition may be adopted, wherein the control means sets the voice encoding means to generation of a silent signal and the noise canceller to an operational state in the event of hand-over or resynchronization processing during a call, and returns the voice encoding means to a normal operational state in response to completion of the hand-over or resynchronization processing.

This invention comprises: a noise canceller for removing noise components from a digital voice signal by extracting the noise components from the digital voice signal and subtracting the extracted noise components from the digital voice signal; voice compressing means for compressing the digital voice signal from which the noise components have been removed by the noise canceller; and control means for starting the operation of the noise canceller before the start of operation of the voice compressing means.

Here, a composition may be adopted, wherein the noise canceller extracts the noise components by a learning process, and the control means starts the learning extraction operation of the noise components by the noise canceller before the start of operation of the voice compressing means by at least a time period required for extraction of the noise components.

This invention comprises: a noise canceller for removing noise components from a digital voice signal by extracting the noise components from the digital voice signal and subtracting the extracted noise components from the digital voice signal; voice compressing means for compressing the digital voice signal from which the noise components have been removed by the noise canceller; and control means for starting the operation of the noise canceller before the start of normal operation of the voice compressing means, and setting the voice encoding means to a silent signal generating state for generating a silent signal until normal operation of the voice compressing means starts.

Furthermore, this invention is a control method for a portable radio telephone device comprising the steps of: removing noise components from a digital voice signal by extracting the noise components from the digital voice signal and subtracting the extracted noise components from the digital voice signal by means of a noise canceller; and compressing the digital voice signal from which the noise components have been removed by voice compressing means, wherein the operation of the noise canceller is started before the start of operation of the voice compressing means.

Moreover, this invention is a control method for a portable radio telephone device comprising the steps of: removing noise components from a digital voice signal by extracting noise components from the digital voice signal and subtracting the extracted noise components from the digital voice signal by means of a noise canceller; and compressing the digital voice signal from which the noise components have been removed by voice compressing means, wherein the operation of the noise canceller is initiated before the start of normal operation of the voice compressing means, and the voice encoding means is set to a silent signal generating state for generating a silent signal until normal operation of the voice compressing means starts.

BEST MODE FOR CARRYING OUT THE INVENTION

Figure 1:
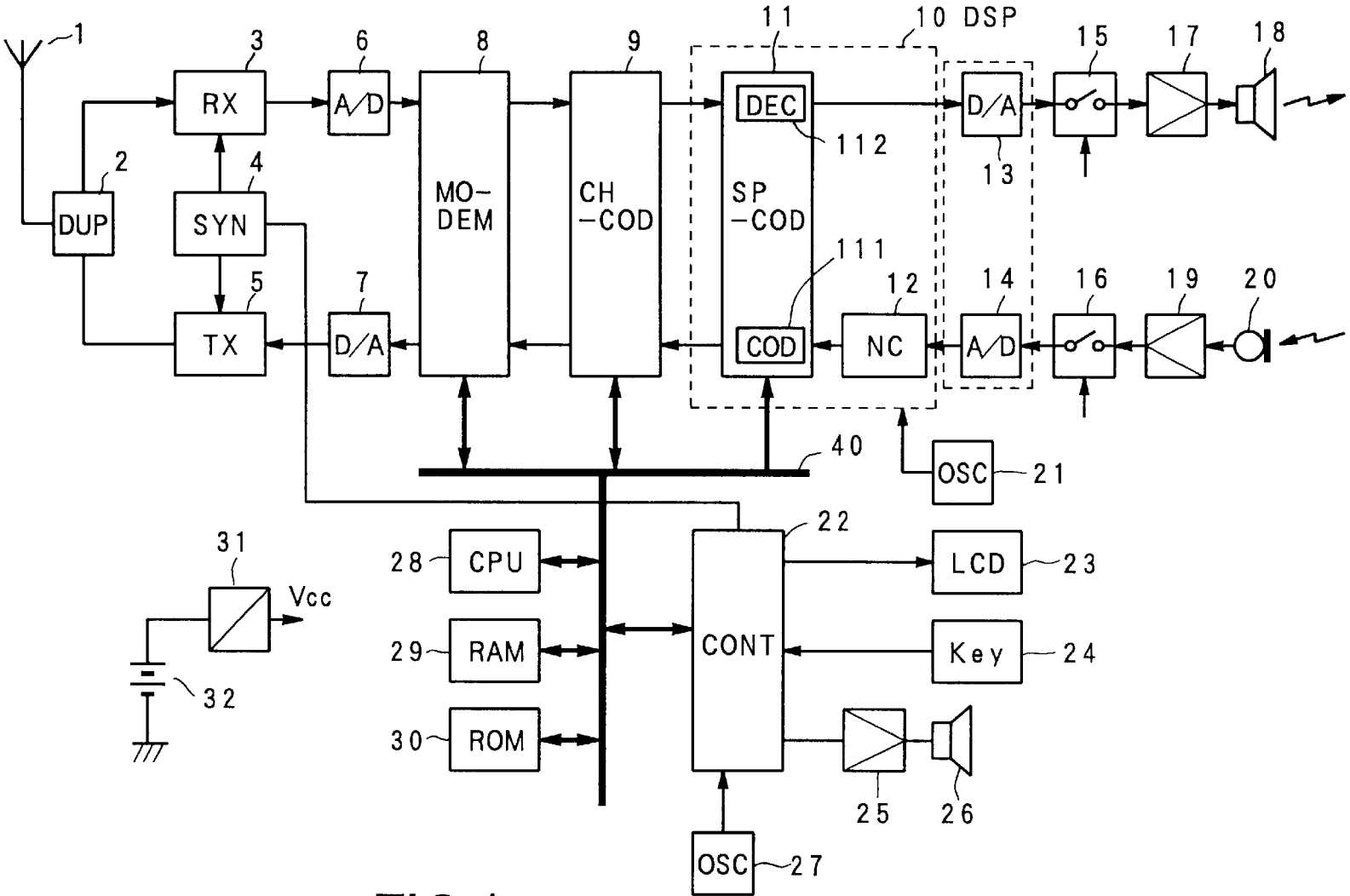
FIG. 1 is a block diagram showing the approximate composition of a portable radio telephone relating to this invention.

Below, a mode for implementing this invention is described in detail with reference to the accompanying drawings. FIG. 1 is a block diagram showing the approximate composition of a portable radio telephone constituted by applying the portable radio telephone device and control method for same relating to this invention.

In FIG. 1, the portable radio telephone comprises: an antenna 1; antenna divider 2; reception circuit 3; synthesizer circuit 4; transmission circuit 5; A/D converter 6; D/A converter 7; modem circuit 8; channel codec 9; DSP 10; D/A converter 13; A/D converter 14; receiver mute switch 15; transmitter mute switch 16; receiver amp 17; receiver 18; transmitter amp 19; transmitter 20; oscillating circuit 21; control circuit (ASIC) 22; LCD display device 23; key unit 24; amp 25; sounder 26; oscillating circuit 27; CPU 28; RAM 29; ROM 30; stabilized power supply circuit 31; and a battery 32. The DSP 10 comprises a speech codec 11 and a noise canceller 12.

A coder 111 and a decoder 112 are provided in the speaker codec 11. Furthermore, the modem circuit 8, channel codec 9, DSP 10, control circuit 22, CPU 28, RAM 29 and ROM 30 are mutually connected by means of a control bus line 40.

In this portable radio telephone, incoming radio waves are received by the antenna 1, and passed to the reception circuit 3 via the antenna divider 2. The reception circuit 3 amplifies the input signal from the antenna divider 2 and then converts it to an IF frequency by mixing down using a local signal supplied by a synthesizer circuit 4, whereupon the signal is amplified again, subjected to orthogonal demodulation, and then input to an A/D converter 6. The A/D converter 6 converts the orthogonally demodulated signal to a digital signal, which it supplies to the modem circuit 8. At the modem circuit 8, frame synchronization and color code detection processing is applied to the digital signal.

Furthermore, the output signal from the modem circuit 8 is de-interleaved and error correction decoded by the channel codec 9 and input to the decoder 112 of the speech codec 11.

In the decoder 112, VSELP decoding processing is applied to the input signal. This decoded signal is then demodulated to a voice signal by the D/A converter 13, passes through the receiver mute switch 15, and is amplified by the receiver amp 17, whereupon it is converted to acoustic output by the receiver 18 and transmitted to the user as sound. Here, the receiver mute switch 15 is controlled by the control circuit 22 and it is set to 'unmute' during communications.

On the other hand, the user s voice is converted to an electrical signal by the transmitter 20, and it is amplified by the transmitter amp 19 and input via the transmitter mute switch 16 to the A/D converter 14, where it is converted to a digital signal and then input to the noise canceller 12 which is located in the DSP 10. Here, the transmitter mute switch 16 is controlled by the control circuit 22, and is set to 'unmute' at call start-up.

The noise canceller 12 cancels unwanted ambient noise and inputs the signal to the coder 111 in the speech codec 11. The coder 111 applies VSELP encoding to the input signal.

The speech codec 11 is controlled via the control bus line 40, and has a function for muting the transmission signal. In the device in this example, this mute function is achieved by, for example, a function whereby a silent signal of "0" frame energy is transmitted as the output of the coder 111. The output from the speech codec 11 undergoes error correction encoding and interleave processing by the channel codec 9, a frame signal and a color code signal are appended by the modem circuit 8, and the transmission timing is set and output, whereupon the signal is converted to an analogue signal by the D/A converter 7 and output to the transmission circuit 5.

The transmission circuit 5 applies orthogonal modulation to the analogue input signal, and this orthogonally modulated signal is converted to a prescribed transmission frequency by mixing up using a local signal supplied by a synthesizer circuit 4, and the signal is further amplified and output. The output from the transmission circuit 5 is transmitted via the antenna divider 2 and the antenna as a radio wave.

The control bus line 40 is a parallel bus signal line, and it forms an interface between the various circuit sections. The control circuit 22 principally outputs control signals to the various circuits described above, and it processes the output signals of these circuits. The LCD display device 23 displays telephone numbers and other states of the portable telephone. The key unit 24 is used by the user for inputting instructions, such as telephone numbers, starting or terminating a call, or the like. A ringing tone and operation confirmation tone are transmitted to the user by amplifying the output of the control circuit 22 at the amp 25 and converting it to an acoustic output at the sounder 26. The oscillating circuits 21, 27 supply prescribed clock signals to the DSP 10 and control circuit 22, respectively. The CPU 28 implements control operations in accordance with programs stored in the ROM 30. The RAM 29 is used as a memory for the settings, telephone number, and the like, of the portable radio telephone. In this device, the stored information is retained even if the device power supply is not switched on, by means of a back-up battery, which is omitted from the drawings. The stabilized power supply circuit 31 stabilizes the output of the battery 32 and supplies power to each circuit section.

Next, a call origination/call reception operation relating to a first mode for implementing this portable radio telephone is described.

In the portable radio telephone according to this mode of implementation, a composition is adopted whereby the speech codec 11 and the noise canceller 12 can operate separately within the DSP 10.

A call of high quality can be conducted from the start of communications, when a call is made or received, by starting up the noise canceller 12 and initiating input learning relating to the ambient noise at the stage that the call channel is started up during the call connection control procedure implemented when a call is made or received.

Figure 2:
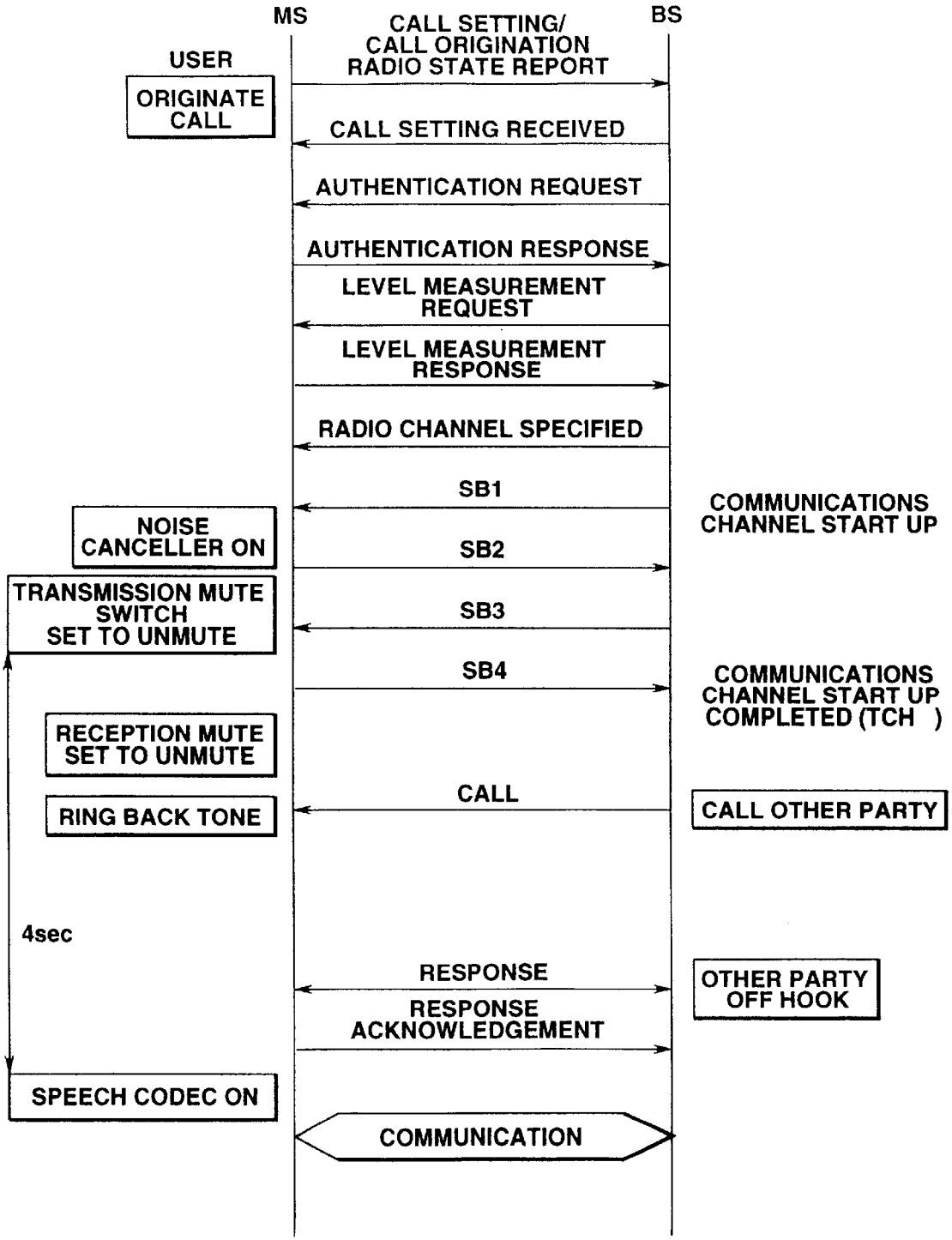
FIG. 2 is a sequence diagram showing a call origination control sequence in a portable radio telephone relating to a first mode of implementation.

FIG. 2 is a control sequence showing one example of a call origination operation in a portable radio telephone according to the first mode of implementation. This control sequence is an example of a case where a portable radio telephone is used as a mobile station MS in a cellular system, for example, and a call origination control procedure as described below is implemented between the mobile station MS and a corresponding base station BS.

Firstly, a call origination operation is started in the portable radio telephone (mobile station MS) by an operation implemented by the user. When the mobile station MS receives this, it transmits "call setting" and "origination radio state report" containing ID information, destination telephone number information, and the like, to the mobile base station BS. The base station BS transmits a "call setting received" in response to the aforementioned "call setting" to the mobile station MS, and it then transmits "authentication request" to confirm authentication.

At the mobile station MS, authentication processing is carried out in response to the reception of the aforementioned "authentication request", whereupon the resulting information is transmitted as an "authentication response" to the base station BS. When the base station BS confirms by receiving the "authentication response" that the terminal is correctly under its control, in order to find out the state of the selected radio channel, it transmits a "level measurement request" seeking a level measurement of this selected channel to the mobile station MS. When the mobile station MS has received the "level measurement request", it makes a level measurement of the prescribed channel and sends this back as a "level measurement response" to the base station BS. The base station BS assesses the state of the radio channel and sends a "radio channel designation" to the mobile station MS, whilst simultaneously transmitting a "synchronization burst SB1" on the communications channel.

Meanwhile, the mobile station MS switches to the prescribed channel and when it receives "synchronization burst SB1", it transmits a "synchronization burst SB2". Furthermore, during this procedure, the mobile station MS switches the noise canceller 12 only to an operational state, whilst the speech codec 11 remains in a non-operational state, the call mute switch 16 is set to 'unmute', and an ambient noise input learning operation is initiated.

In order to confirm its timing with the mobile station MS upon receiving "synchronization burst SB2", the base station BS transmits a "synchronization burst SB3" containing prescribed time alignment information. The mobile station MS reads the time alignment information by receiving this "synchronization burst SB3", and it transmits a "synchronization burst SB4" as a response to the base station BS. Upon receiving "synchronization burst SB4", the base station BS identifies that start-up of the communications channel has been completed, and it transmits normal slot data and establishes a communications channel.

Thereupon, the base station BS transmits a "calling" message to the mobile station MS to indicate that it has called up the telephone of the other party. Upon receiving this "calling" message, the mobile station MS generates a tone in the DSP 10, sets the call mute switch 15 to 'unmute', and outputs a ring back tone to the user from the receiver 18. If the other party s telephone is off the hook, the base station sends a "response" indicating this to the mobile station MS. The mobile station MS sends a "response confirmation" to the base station BS to confirm that it has received this "response". The mobile station MS then sets the speech codec 11, which has been idle thus far, to an operational state, and communication is started. In this way, the telephone enters a communicating state, but in this control sequence, it usually takes approximately 4 seconds to reach this communicating state from start-up of the noise canceller 12 after start-up of the communications channel. This time is sufficient for the noise canceller 12 to converge, and therefore stable high-quality communications, wherein the noise canceller is effective immediately after the start of communication, can be implemented.

Figure 3:
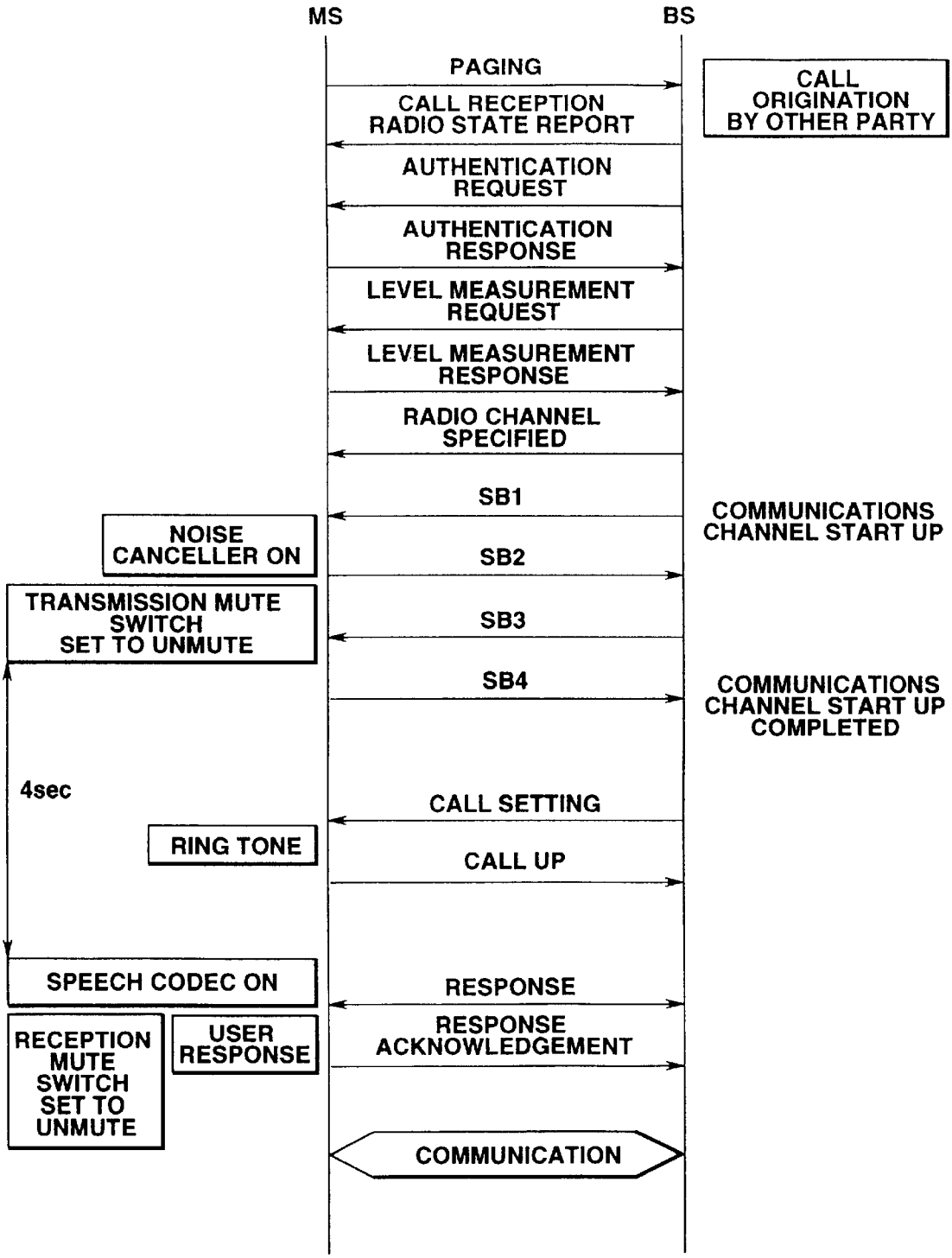
FIG. 3 is a sequence diagram showing a call reception control sequence in a portable radio telephone relating to a first mode of implementation.

Next, a call reception operation in the mobile station MS according to this first mode of implementation is described with reference to the control sequence shown in FIG. 3. Here, description relating to sections which are common to the call origination sequence described above are simplified. In the call reception operation of this mobile station MS, firstly, upon receiving a call origination from the telephone of another party, the base station BS transmits a "paging" message to the called mobile station MS. Upon receiving this "paging" message, the mobile station MS makes an ID confirmation and if it judges that it is the station being called, it transmits a "reception radio state report" to the base station BS. Thereupon, the base station BS and the mobile station MS exchange "authentication request", "authentication response", "level measurement request", "level measurement response" and "radio channel designation", similarly to the aforementioned call origination sequence, and the base station BS starts up a communications channel and transmits a "synchronization burst SB1" to the mobile station MS on this communications channel.

Meanwhile, the mobile station MS switches to the prescribed channel, and when it receives "synchronization burst SB1", it transmits "synchronization burst SB2" as a response to the base station BS. During this, the base station BS switches the noise canceller 12 only to an operational state, whilst the speech codec 11 remains idle, the transmitter mute switch 16 is set to 'unmute' and an ambient noise input learning operation is started. Thereupon, "synchronization burst SB3" and "synchronization burst SB4" are exchanged between the base station BS and the mobile station MS, and upon receiving "synchronization burst SB4", the base station BS confirms that the communications channel start-up operation has been completed, and it establishes a communications channel by transmitting normal slot data.

After communications channel start-up has been completed, the base station BS transmits "call setting" to the mobile station MS. When the mobile station MS receives the aforementioned "call setting", a ringing tone is emitted from the sounder 26 to the user. The mobile station MS also transmits "calling" to the base station BS as a response to the aforementioned "call setting". If the user operates the reply key on the key unit 24 at the mobile station MS whilst the ringing tone is sounding, a "response" message is transmitted from the mobile station MS to the base station BS. Furthermore, at the mobile station MS, when the user implements the aforementioned response operation, the receiver mute switch 15 is turned to 'unmute', and the speech codec 11 is switched to an operational state. The base station BS transmits "response confirmation" to the mobile station MS to confirm that it has received the "response". By this means, the telephone assumes a communicating state, but in this call reception operation, the noise canceller 12 converges sufficiently in the period from start up of the noise canceller 12 until the communicating state is reached, and therefore high-quality communications can be conducted from immediately after the start of communication.

Next, a call origination/call reception sequence in a portable radio telephone relating to a further mode for implementing the present invention is described. The portable radio telephone relating to this mode of implementation has a composition whereby the DSP 10 cannot control the speech codec 11 and the noise canceller 12 independently of each other. However, this speech codec 11 comprises a transmitter muting function whereby the transmitter can be switched from a speech signal transmission state at a normal voice level to a transmission state where the voice level is a minimum, in other words, a silent signal transmission state having frame energy of "0".

Figure 4:
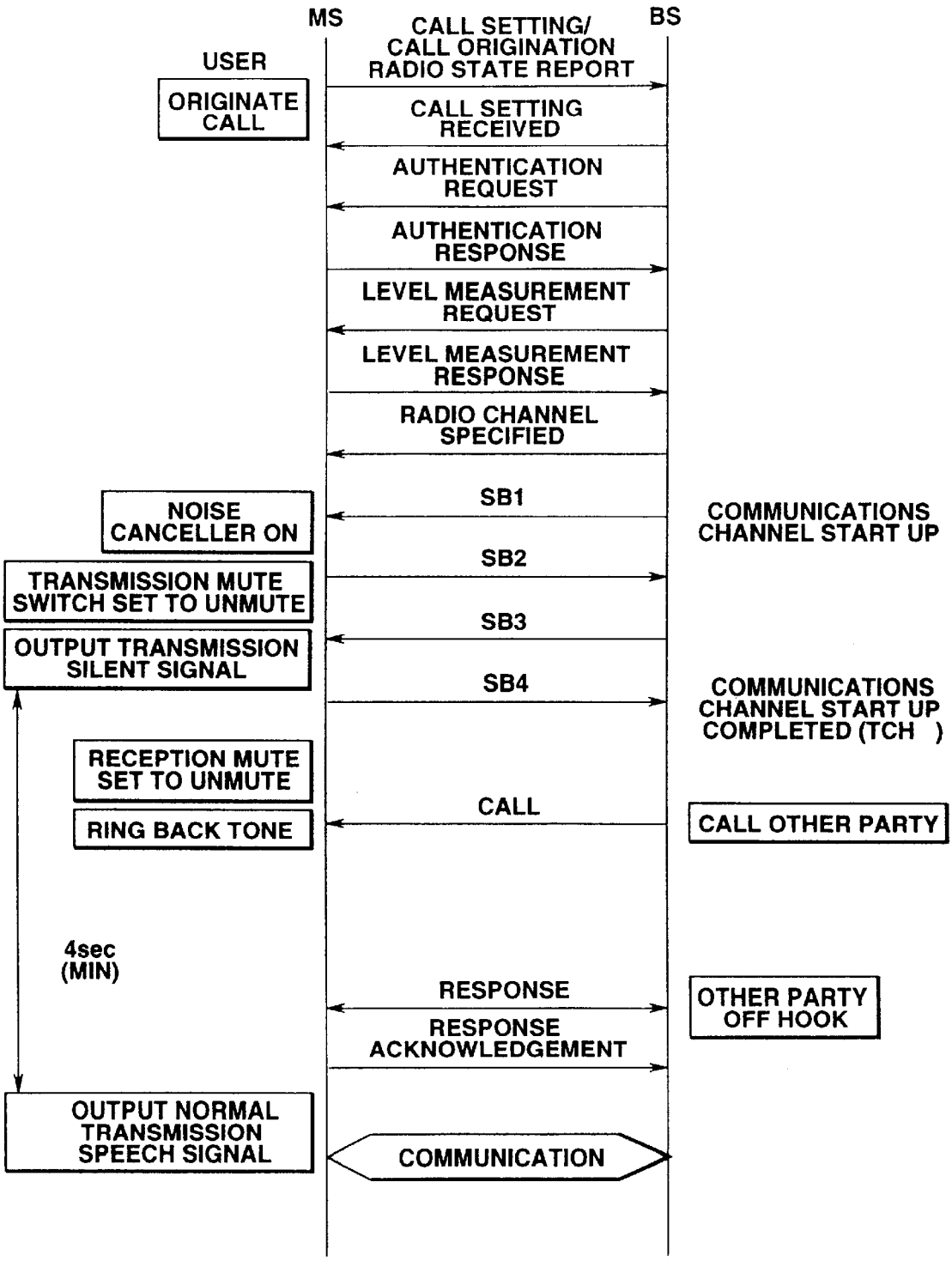
FIG. 4 is a sequence diagram showing a call origination control sequence in a portable radio telephone relating to a second mode of implementation.

FIG. 4 is a control sequence showing one example of a call origination operation in a portable radio telephone relating to the second mode of implementation. The basic control procedure relating to call origination in the portable radio telephone (mobile station MS) is the same as in the first mode of implementation illustrated in FIG. 2. However, in this mode of implementation, the aforementioned DSP 10 composition is used and after transmitting "synchronization burst BS2", the mobile station MS sets the speech codec 11 and the noise canceller 12 in the DSP 10 to an operational state simultaneously, and when the transmitter mute switch is set to 'unmute' and an ambient noise input learning operation is started, the speech codec 10 transmits a silent signal of frame energy "0" as the transmission voice output. Thereupon, the mobile station MS exchanges "synchronization burst SB3", "synchronization burst SB4", "calling" and "response" with the base station BS, and it then transmits "response confirmation" to the base station BS. Here, the mobile station MS returns the speech codec 11, which has been transmitting a silent signal of frame energy "0" thus far, to a normal state, a transmission speech signal is output at a normal voice level, and communication starts.

Figure 5:
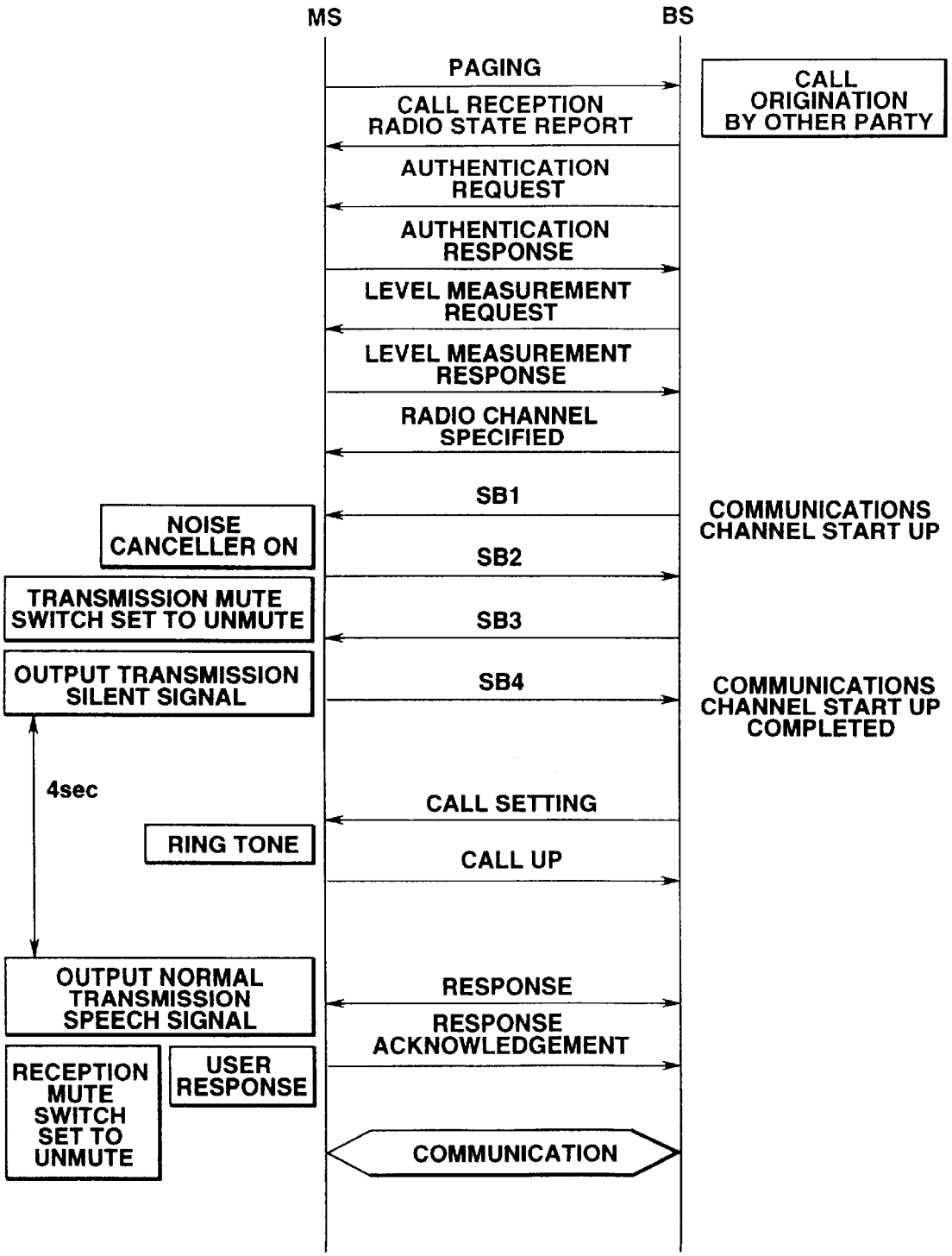
FIG. 5 is a sequence diagram showing a call reception control sequence in a portable radio telephone relating to a second mode of implementation.

FIG. 5 is a control sequence showing one example of a call reception operation in a mobile station MS relating to a second mode of implementation. This call reception operation in the mobile station MS is essentially similar to the call origination operation illustrated in FIG. 4. In other words, in this call reception operation, after transmitting "synchronization burst SB2", the mobile station MS sets the speech codec 11 and the noise canceller 12 to an operational state simultaneously, the transmitter mute switch 16 is set to 'unmute' and an ambient noise input learning operation is started. Here the speech codec 11 transmits a silent signal of frame energy "0" as the transmission voice output. Thereupon, the mobile station MS exchanges "synchronization burst SB3", "synchronization burst SB4", "call setting", "calling", "response" and "response confirmation" with the base station BS, and it enters a communicating state. If the user operates the response key during this, for example, whilst the ringing tone is being emitted due to the reception of the aforementioned "call setting" message, then the reception mute switch 15 is set to 'unmute', the transmission operation of the speech codec 11, which has been transmitting a silent signal of frame energy "0" thus far is returned to a normal state, and communication is started by outputting a transmission speech signal at a normal voice level.

As described above, in the second mode of implementation similarly to the first mode of implementation, when a call is made or received, the noise canceller 12 always completes convergence fully within a time period of four seconds, for example, until a communicating state is reached, and therefore communications of stable quality can be conducted from immediately after the start of communication.

Figure 6:
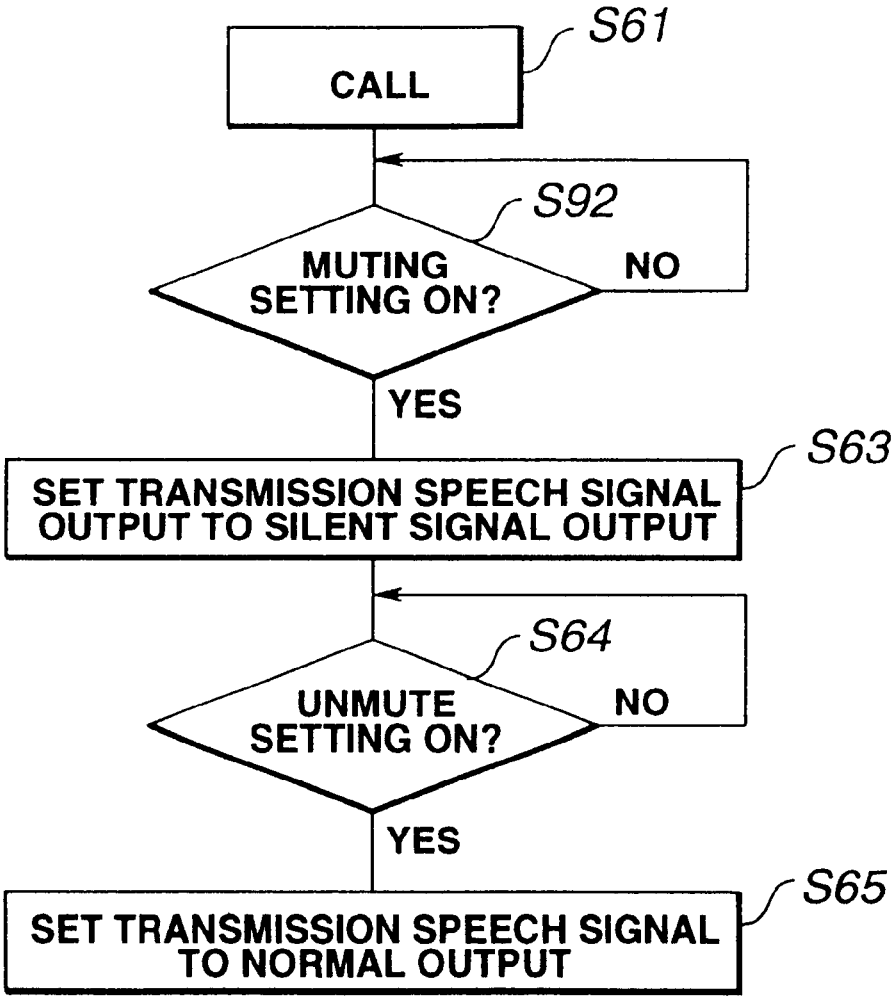
FIG. 6 is a flowchart showing a communications muting operation in a portable radio telephone relating to this invention.

In the portable radio telephone according to this invention, a function for muting the transmission signal is appended in order that the user can, for example, prevent the other party to the call from hearing his or her side of the conversation during a call. Below, the operational control implemented in the event of an in-call muting operation in the portable radio telephone according to the present invention is described with reference to the flowchart in FIG. 6.

In the communicating state (step 61), the control circuit 22 judges whether or not a muting operation has been implemented by the telephone user by monitoring key input from the key unit 24 (step 62). Here, if it is judged that a mute setting has been implemented by key input corresponding to the mute key on the key unit 25 (step 62 YES), then the control circuit 22 transmits a silent signal of frame energy "0" as a transmission voice output from the speech codec in the DSP 10 (step 63), and it enters mute operation.

Subsequently, the control circuit 22 monitors whether or not a cancel muting operation has been implemented by monitoring the aforementioned key input (step 64), and if it determines here that the device has been returned to an 'unmute' setting, due to the fact that the key input corresponding to the aforementioned mute key has ceased, then it returns the transmission operation of the speech codec 11, which has been outputting a silent signal of "0" frame energy thus far, to a normal state, the transmission speech signal is output as a normal voice level (step 65), and the. device returns to a communicating state. In this portable radio telephone, the control circuit 22 keeps the noise canceller 12 in an operational state, even during the aforementioned muting operation. Therefore, since the noise canceller 12 maintains a converged state throughout the muting operation, a call of high quality can be restarted immediately when the device reverts to an 'unmute' state.

In the foregoing mode of implementation, a composition was adopted wherein a silent signal of frame energy "0" was transmitted from the speech codec 11 in the DSP 10 as the transmission voice output during a muting operation, but it is also possible to control device such that the speech codec 11 in the DSP 10 assumes a suspended state.

Furthermore, in this invention, control similar to that implemented in the event of the aforementioned in-call muting operation can also be applied during a call "disconnection" due to hand-over (processing for ending connection with base station currently in communication and reconnecting with a different base station in accordance with received control information, due to detected degradation of the radio reception level, etc.) or resynchronization in the event of loss of frame synchronization, or the like. In other words, during hand-over or resynchronization due to loss of frame synchronization, etc., also, the noise canceller 12 is controlled such that it continues to operate as if the transmission mute function was idle, and during the aforementioned muting period, a silent signal is transmitted from the speech codec 11, and when the device returns from hand-over or resynchronization processing, output of the transmission speech signal starts at a normal voice level. Here, for example, during resynchronization processing the voice is in a "disconnected" state for approximately several 100 ms, but by making the noise canceller 12 continue to operate during this period, it is possible to prevent completely the other party from hearing any unexpected noise immediately after the device returns from this "disconnected" state. Furthermore, in this case also, instead of transmitting a silent signal from the speech codec 11, it is also possible to control the speech codec 11 such that it assumes a suspended state.

As described above, according to the present invention, since a composition is adopted whereby the operation of the speech codec can be controlled such that the transmission mute is set to an unmuted state and the noise canceller is set to an operational state, an operation is possible whereby, during execution of call origination or call reception control procedures, in the stage before there has been sufficient time for the noise canceller to converge from the subsequent point in time when the telephone conversation can be expected to start, the speech codec is set to an idle state, whilst the noise canceller is started up and a learning operation is initiated.

By this means, in the present invention, whilst the communications channel is started up according to the aforementioned control procedures, the speech codec is set to an idle state and the transmission mute of the noise canceller is set to 'unmute' and convergence of the noise canceller is started by inputting ambient noise, whereupon, when the transmission and reception of the response signal has been completed by means of a response by the user, the speech codec is set to an operational state, and therefore the noise canceller is allowed to converge sufficiently by the time that the aforementioned transmission and reception of the response signal has been completed, in other words, when the telephone conversation starts, and a clear voice signal can be transmitted to the other party, with the noise canceller in an operational state, from the start of the call.

Furthermore, in this invention, a speech codec having a transmission mute function, whereby a silent signal of minimum voice level can be output as the transmission voice signal, is used, the aforementioned silent equivalent signal being transmitted as the transmission voice signal from the speech codec during communication channel start-up according to the aforementioned control procedures, whilst the transmission mute of the noise canceller is set to 'unmute' and the noise canceller starts convergence by inputting ambient noise, and when transmission and reception of the response signal has been completed by means of a response by the user, the transmission mute function of the speech codec is cancelled and output of a transmission voice signal at normal voice level is started, thereby allowing the noise canceller to converge sufficiently by the start of the call, and thus enabling a clear voice signal to be communicated from the very start of the call.

Furthermore, in a device using a speech codec having the aforementioned transmission mute function, when muting is initiated by the user during a call, muting is implemented by outputting the aforementioned silent signal as the transmission voice signal, whilst the transmission mute of the noise canceller is set to 'unmute' and the noise canceller maintains its converged state by inputting ambient noise, thereby making it possible to prevent the other party from hearing unwanted ambient noise when the device reverts to 'unmute'. Moreover, by means of a similar operation, in the event of hand-over or resynchronization processing also, the noise canceller can maintain perfectly clear communication right from the point that the device returns from these processing operations.

The aforementioned operational control in the present invention can be adapted readily by changing the processing program in the DSP, and since this is achieved without increasing the hardware, it is extremely beneficial for compactifying, and reducing the cost of, the portable radio telephone.

INDUSTRIAL APPLICABILITY

This invention can be applied to a portable radio telephone device and a control method for same, used as a mobile station in a cellular system, PHS (personal handyphone system), or the like. According to this invention, a composition is adopted whereby, when the speech codec is set to a normal operational state, the noise canceller is operated for at least a time period required for the aforementioned learning operation before the speech codec starts operation, and therefore it is possible to eliminate unstable operation of the noise canceller at the start of a communication due to call origination or call reception, or when in-call muting is cancelled, or after completion of a hand-over or resynchronization processing operation, thereby enabling call quality to be improved.

What is claimed is:

1. A portable radio telephone device comprising:

a noise canceller for extracting noise components from a transmission voice signal and mixing components of opposite phase to the extracted noise components into the transmission voice signal;

voice encoding means for encoding the transmission voice signal from which the noise components have been removed by the noise canceller; and control means for activating the noise canceller before the start of operation of the voice encoding means and starting the operation of the voice encoding means after passage of a time required for the noise component removal operation by the noise canceller.

2. The portable radio telephone device according to claim 1, wherein:

the noise canceller comprises an adaptive filter for extracting noise components from the transmission voice signal, the adaptive filter determines a filter tap coefficient by means of an operation such that the operation is optimal with respect to the extracted noise components contained in the transmission voice signal, and the control means operates the noise canceller before an operation start time point of the encoding means by at least a time period required for the filter tap coefficient to converge.

3. The portable radio telephone device according to claim 1, wherein, during start-up of a communications channel relating to call origination or call reception, the control means sets the noise canceller to an operational state, and sets the voice encoding means to an operational state after a response by a user on the communications channel.

4. The portable radio telephone device according to claim 1, wherein the control means sets the voice encoding means to an idle state and the noise canceller to an operational state in response to a muting operation during a call, and sets the voice encoding means to an operational state in response to cancellation of the muting operation.

5. The portable radio device according to claim 1, wherein the control means sets the voice encoding means to an idle state and the noise canceller to an operational state in the event of hand-over or resynchronization processing during a call, and sets the voice encoding means to an operational state in response to completion of the hand-over or resynchronization processing.

6. A portable radio telephone device comprising:

a noise canceller for extracting noise components from a transmission voice signal and mixing components of opposite phase to the extracted noise components into the transmission voice signal;

voice encoding means for encoding the transmission voice signal from which the noise components have been removed by the noise canceller; and control means for activating the noise canceller before the start of operation of the voice encoding means, starting the operation of the voice encoding means after passage of a time required for the noise component removal operation by the noise canceller, and setting the voice encoding means to a silent signal generating state for generating a silent signal until normal operation of the voice encoding means starts.

7. The portable radio telephone device according to claim 6, wherein:

the noise canceller comprises an adaptive filter for extracting noise components from the transmission voice signal, the adaptive filter determines a filter tap coefficient by means of an operation such that the operation is optimal with respect to the extracted noise components contained in the transmission voice signal, and the control means operates the noise canceller before an operation start time point of the encoding means by at least a time period required for the filter tap to converge.

8. The portable radio telephone device according to claim 6, wherein during start-up of a communications channel relating to call origination or call reception, the control means sets the voice encoding means to generation of a silent signal and the noise canceller to an operational state, and returns the voice encoding means to a normal operational state after a response by a user on the communications channel.

9. The portable radio telephone device according to claim 6, wherein the control means sets the voice encoding means to generation of a silent signal and the noise canceller to an operational state in response to a muting operation during a call, and returns the voice encoding means to a normal operational state in response to cancellation of the muting operation.

10. The portable radio telephone device according to claim 6, wherein the control means sets the voice encoding means to generation of a silent signal and the noise canceller to an operational state in the event of hand-over or resynchronization processing during a call, and returns the voice encoding means to a normal operational state in response to completion of the hand-over or resynchronization processing.

11. A portable radio telephone device comprising:

a noise canceller for extracting noise components from a transmission voice signal and subtracting the extracted noise components from the transmission voice signal;

voice compressing means for compressing the transmission voice signal from which the noise components have been removed by the noise canceller; and control means for starting the operation of the noise canceller before the start of operation of the voice compressing means, and starting the operation of the voice compressing means after passage of a time required for the noise component removal operation by the noise canceller.

12. The portable radio telephone device according to claim 11, wherein:

the noise canceller comprises an adaptive filter for extracting the noise components from the transmission voice signal, the adaptive filter determines a filter tap coefficient by means of an operation such that the operation is optimal with respect to the extracted noise components contained in the transmission voice signal, and the control means operates the noise canceller before an operation start time point of the voice compressing means by at least a time period required for the filter tap coefficient to converge.

13. A portable radio telephone device comprising:

a noise canceller for extracting noise components from a transmission voice signal and subtracting the extracted noise components from the transmission voice signal;

voice compressing means for compressing the transmission voice signal from which the noise components have been removed by the noise canceller; and control means for activating the noise canceller before the start of a normal operation of the voice compressing means, starting the normal operation of the voice compressing means after passage of a time required for the noise component removal operation by the noise canceller, and setting the voice compressing means to a silent signal generating state for generating a silent signal until the normal operation of the voice compressing means starts.

14. The portable radio device according to claim 13, wherein;

the noise canceller comprises an adaptive filter for extracting the noise components from the transmission voice signal, the adaptive filter determines a filter tap coefficient by means of an operation such that the operation is optimal with respect to the noise components contained in the transmission voice signal, and the control means operates the noise canceller before an operation start time point of the voice compressing means by at least a time period required for the filter tap coefficient to converge.

15. A control method for a portable radio telephone device comprising the steps of:

performing a noise component removal operation for removing noise components from a transmission voice signal by extracting the noise components from the transmission voice signal and subtracting the extracted noise components from the transmission voice signal by means of a noise canceller; and compressing, by voice compressing means, the transmission voice signal from which the noise components have been removed by the noise component removal operation, wherein the operation of the noise canceller is started before the start of operation of the voice compressing means, and the operation of the voice compressing means is started after passage of a time required for the noise component removal operation by the noise canceller.

16. The control method for a portable radio telephone device according to claim 15, wherein:

the noise canceller comprises an adaptive filter for extracting the noise components from the transmission voice signal, the adaptive filter determines a filter tap coefficient by means of an operation such that the operation is optimal with respect to the noise components contained in the transmission voice signal, and the control means operates the noise canceller before an operation start time point of the voice compressing means by at least a time period required for the filter tap coefficient to converge.

17. A control method for a portable radio telephone device comprising the steps of:

performing a noise component removal operation for removing noise components from a transmission voice signal by extracting the noise components from the transmission voice signal and subtracting the extracted noise components from the transmission voice signal by means of a noise canceller; and compressing, by voice compressing means, the transmission voice signal from which the noise components have been removed by the noise component removal operation, wherein the operation of the noise canceller is initiated before the start of operation of the voice compressing means, a normal operation of the voice compressing means is started after passage of a time required for the noise component removal operation by the noise canceller, and the voice compressing means is set to a silent signal generating state for generating a silent signal until the normal operation of the voice compressing means starts.

18. The control method for a portable radio telephone device according to claim 17, wherein:

the noise canceller comprises an adaptive filter for extracting the noise components from the transmission voice signal, the adaptive filter determines a filter tap coefficient by means of an operation such that the operation is optimal with respect to the noise components contained in the transmission voice signal, and the control means operates the noise canceller before an operation start time of the voice compressing means by at least a time period required for the filter tap coefficient to converge.

* * * * *